US007730923B2

(12) United States Patent
Zhang

(10) Patent No.: US 7,730,923 B2
(45) Date of Patent: Jun. 8, 2010

(54) ADJUSTABLE HANGING APPARATUS FOR BLIND VALANCES

(75) Inventor: De-Jun Zhang, Dongguan (CN)

(73) Assignee: Niem Made Enterprise Co., Ltd., Taichung (TW)

( * ) Notice: Subject to any disclaimer, the term of this patent is extended or adjusted under 35 U.S.C. 154(b) by 187 days.

(21) Appl. No.: 11/882,748

(22) Filed: Aug. 3, 2007

(65) Prior Publication Data

US 2009/0032200 A1 Feb. 5, 2009

(51) Int. Cl.
*E04F 10/00* (2006.01)

(52) U.S. Cl. ..... 160/38; 160/39; 160/19; 160/178.1 R; 160/178.1 V; 160/902; 248/339; 24/462; 403/397

(58) Field of Classification Search ..... 160/38, 160/39, 19, 178.1 R, 178.1 V, 902; 248/322, 248/339, 264, 268; 24/462, DIG. 43, DIG. 44, 24/DIG. 45, DIG. 47, 593.1, 591.1, 594.11; 403/397, 329, DIG. 14, DIG. 11
See application file for complete search history.

(56) References Cited

U.S. PATENT DOCUMENTS 4,384,605 A * 5/1983 Schaeffer et al. ..... 160/38
5,507,460 A * 4/1996 Schneider ..... 248/225.21
5,529,273 A * 6/1996 Benthin ..... 248/254
6,309,134 B1 * 10/2001 Hann ..... 403/326
6,601,809 B1 * 8/2003 Gebrara ..... 248/229.16
6,672,359 B2 * 1/2004 Morris ..... 160/38
6,932,226 B2 * 8/2005 Hardy ..... 211/119.003
7,198,088 B2 * 4/2007 McMenamin et al. ..... 160/89
7,370,588 B2 * 5/2008 Franco ..... 108/90
7,451,956 B2 * 11/2008 Bohlen ..... 248/265
2003/0201072 A1 * 10/2003 Bergeron et al. ..... 160/38
2008/0042034 A1 * 2/2008 Krohmer ..... 248/339
2008/0169067 A1 * 7/2008 Zhang ..... 160/38
2008/0251673 A1 * 10/2008 Mammi ..... 248/339

* cited by examiner

*Primary Examiner*—Katherine W Mitchell
*Assistant Examiner*—Philip S Kwon
(74) *Attorney, Agent, or Firm*—Birch, Stewart, Kolasch & Birch, LLP

(57) ABSTRACT

An adjustable hanging apparatus for blind valances is provided. The hanging apparatus includes a hanging device and a mounting device. The hanging device has a hook, which can be slidably hooked over a headrail. In addition, a base of the hanging device has an opening. The opening is disposed with two resilient mounting plates, and each mounting plate has a plurality of troughs. A neck portion is formed therebetween the mounting plates. The mounting device has a joint portion, which can engage with the valance. Also, a jam portion passes through the neck portion and mounted therein. Positioning flanges can be engaged with the troughs of the mounting plates so as to limit the vertical movement of the mounting device, and the mounting device can be inserted through the opening in the vertical direction of any positions to adjust the valance to desired positions.

9 Claims, 7 Drawing Sheets

ADJUSTABLE HANGING APPARATUS FOR BLIND VALANCES

BACKGROUND OF THE INVENTION

1. Field of Invention

The present invention relates to an adjustable hanging apparatus for blind valances, especially for a hanging apparatus with which the valance can be hanged on a headrail and the height of the valance can be flexibly adjusted.

2. Related Art

Because of privacy concerns and interior decoration designs, consumers usually install window blinds, and a headrail is required for installing window blinds. Therefore, in order to match the decoration, a valiance is added on the front wall of the headrail to conceal the headrail so as to enhance the aesthetic appearance thereof.

The method for mounting the valance over a headrail is rapidly improved. In Morris U.S. Pat. No. 6,672,359, a valance mounting system is disclosed. The system comprises a clip and a slide. The clip includes an arm which is used to hang on a top edge of a front side surface of the headrail and a longitudinally extending tongue. And the slide has a longitudinally extending front surface, so that the tongue can be installed in a slidabe manner, and the clip and the slide can have a relative longitudinal movement with respect to each other. Besides, the slide has a projecting so as to mount the slide with the valance.

In order to let the clip can have a relative longitudinal movement with the slide and can be positioned thereon, a side wall is extending from the two sides of the front surface of the slide respectively. The sidewalls and tabs together form a groove, so that the tongue of the clip can be longitudinally inserted into the groove. Moreover, a surface of the clip close to the slide has a plurality of raised ridges, and the slide has a rib corresponding to the ridges. Therefore, the rib can be mounted and against between two adjacent ridges, so that the functions of performing relative longitudinal movements and positions between the clip and the slide can be achieved.

However, in order to let the clip longitudinally move along the slide, the size of the rib can not be too big; otherwise, the clip will be stuck in the slide and unable to perform the longitudinal movement along the slide. On the other hand, the size of the rib cannot be too small either; or the rib cannot achieve a satisfactory positioning effect, especially when the size and overall weight of the valance are relatively lengthy and heavy.

The aforesaid Morris '359 patent, it disclosed that the projecting of the slide is a cam, so that the projecting can be transversely inserted into the groove. Then, the slide is turned to 90 degree, so that the projecting can be tightly inserted into the groove. It is necessary, of course, to let the projecting being firmly mounted to the groove, the space between the projecting and the groove has to be as minimum as possible; therefore, a certain force must be applied to the slide during installation; however, in the prior art, because the slide is a flat-funnel structure, there is less likely to have any position that allows an operator to apply force thereon, resulting in the problems of inconvenience operation and being difficult to assembly too.

Therefore, this type of arrangement suffers from a number of drawbacks and a need arisen to further improve such valance mounting system and a method for mounting valances on headrails which is user-friendly and further provides a great flexibility at valance height adjustability with respect to the headrails.

SUMMARY OF THE INVENTION

In view of the above problems, one aspect of the present invention is to provide an adjustable hanging apparatus for blind valances, such that a mounting device connected with the valance can be horizontally inserted into the hanging device along a transverse direction of the opening in any arbitrary place of the hanging device and then be mounted thereon. Therefore, the valance can be positioned at a desired height after being adjusted. Another aspect of the present invention is to provide an adjustable hanging apparatus, such that the mounting device is easily rotated to insert into the groove of the valance so as to achieve the easy and user-friendly operation effects.

In one preferred embodiment, the adjustable hanging apparatus comprises a hanging device and a mounting device. The hanging device has a base, and a hook is extending from the base, so that the base can be hooked on a headrail. In addition, two sides of accommodation space of the base have a mounting plate respectively, and each mounting plate is a resilient plate. The space between protruding portions of the two mounting plates forms a neck portion, and each mounting plate has a plurality of troughs. Besides, the mounting device has a joint portion corresponding to the groove of the valance, so that the joint portion can be engaged with the groove, and the mounting device can be mounted with the valance. In addition, the mounting device has a jam portion that can be inserted into or pulled out from the place between the two mounting plates. When the jam portion is inserted into between the two mounting plates, the head of the jam portion is mounted in the neck portion of the accommodation space, so that the movement in the horizontal direction of the mounting device will be limited, and positioning flanges on two sides of the jam portion are engaged with the troughs of the two mounting plates respectively, so that the movement in the vertical direction of the mounting device will be limited.

In addition, tabs are disposed on between the jam portion and the joint portion of the mounting device, and tabs are used for receiving external force to rotate the mounting device as so to engage the joint portion to the valance. Or, a slot is disposed on between the jam portion and the joint portion of the mounting device, so that an assistant tool means can insert into to the slot to turn the mounting device so as to engage the joint portion to the valance.

Therefore, after the valance engaged with the mounting device and being adjusted to the desired height, the jam portion of the mounting device can be horizontally inserted into the accommodation space of the hanging device to be firmly mounted. If the height of the valance has to be re-adjusted, the jam portion is firstly pulled out, and then the height of the valance is adjusted to the required position afterwards. Then, again the jam portion of the mounting device is horizontally inserted into the accommodation space of the hanging device to be firmly re-mounted. Hence, the valance is easily adjusted to the desired height and securely positioned thereon.

Moreover, the tabs of the mounting device are used for operator to hold and apply force to substantially rotate the mounting device to a degree so as to mount the mounting device to the valance, or one can insert an assistant tool means into the slot for applying external force on the mounting device to mount the mounting device to the valance, and thusly achieve the effects of convenient installation.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and which thus is not limitative of the present invention, and wherein.

DETAILED DESCRIPTION OF THE INVENTION

The features and practice of the present invention will be illustrated below in detail through preferred embodiments with reference to the accompanying drawings.

Figure 1:
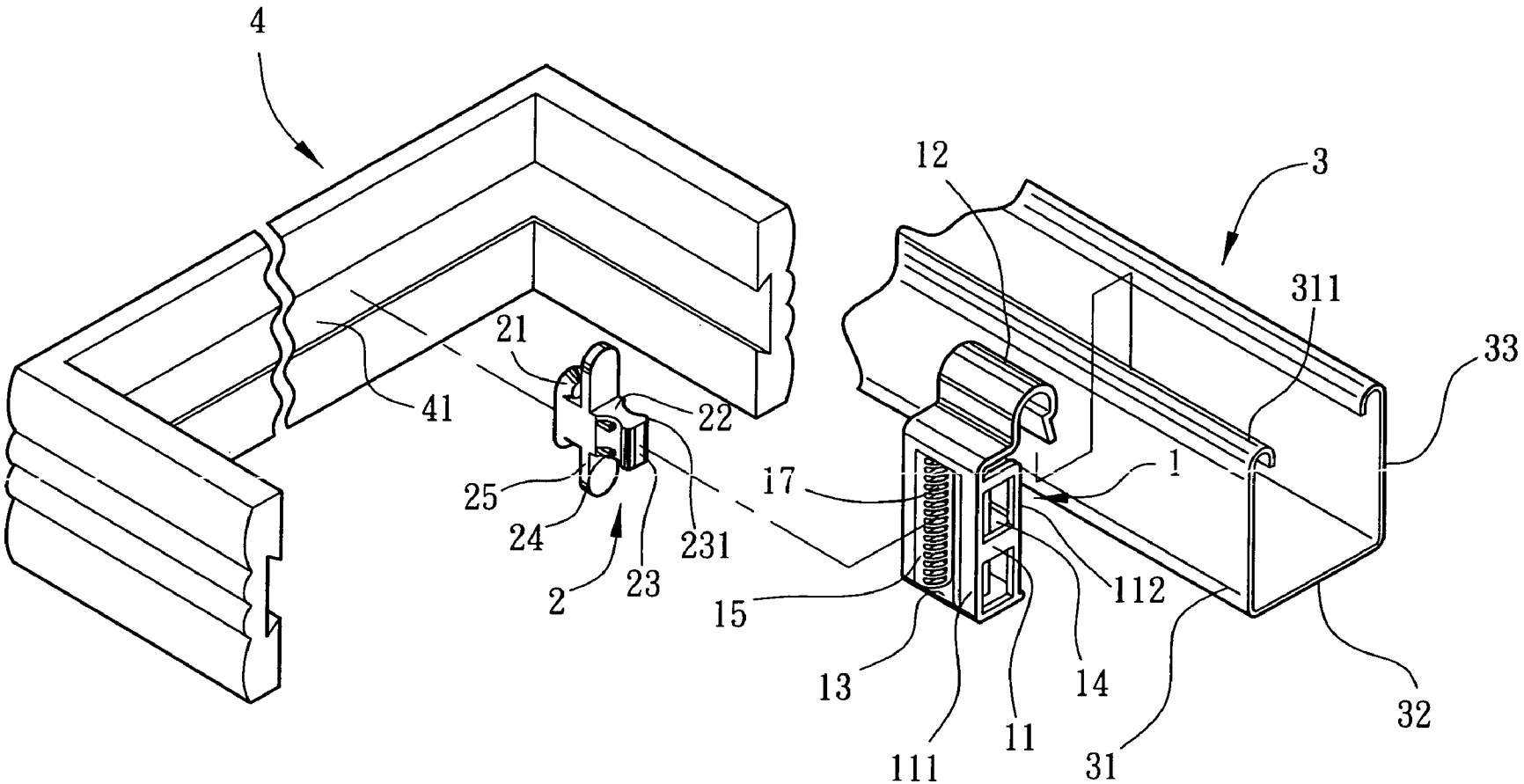
FIG. 1 is a perspective view of a headrail, a valance and one embodiment of the hanging apparatus of the present invention in which no assembly has yet taken place.
Figure 2:
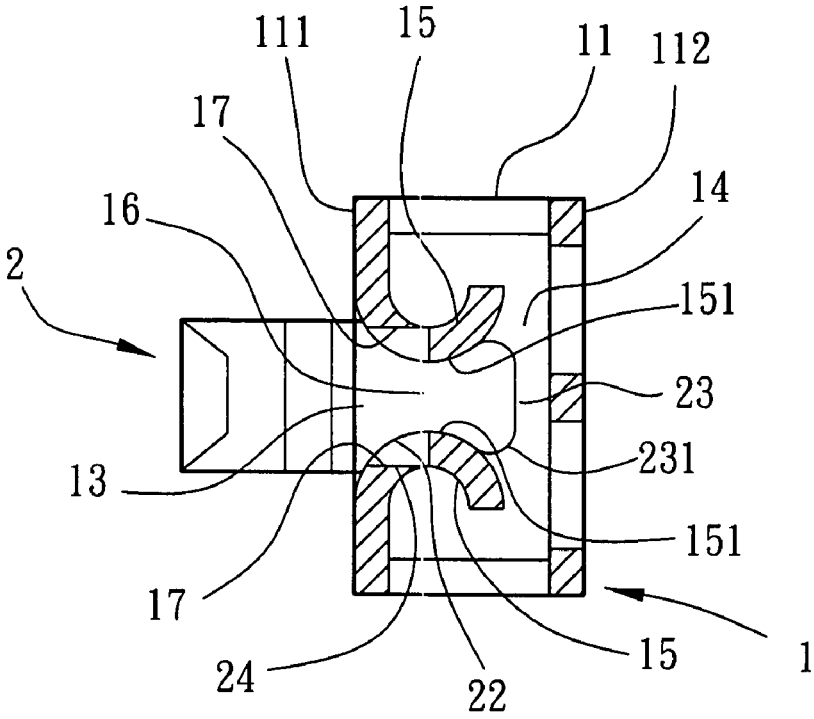
FIG. 2 is a sectional view of the assembly of the hanging device and the mounting device of the present invention.

A first preferred embodiment of the present invention is shown in FIGS. 1 to 7. As best seen in FIGS. 1 and 2, the adjustable hanging apparatus of the present invention comprises a hanging device 1 and a mounting device 2. The hanging device 1 is used to hang and mount over a predetermined position of a headrail 3 of a window blind, and the mounting device 2 is used to engage with a valance 4. By mounting the mounting device 2 to the hanging device 1, the valance 4 can be hung on the headrail 3 and the height of the valance 4 is relatively adjustable.

The cross-section profile of the headrail 3 is U-shaped, and the headrail 3 has a front side surface 31, a bottom surface 32, and a rear side surface 33. One end of the front side surface 31, where is far away from the bottom surface 32, is bent inwardly to form a top edge 311, so that the hanging device 1 can be securely mounted over the predetermined position of the top edge 311.

One surface of the valance 4 near the headrail 3 has a horizontal elongated groove 41, and the cross-section profile of the groove 41 is dovetailed-shaped, so that the mounting device 2 can be releasably mounted therein.

In the embodiments of FIGS. 1-2, the hanging device 1 of the present invention comprises a base 11. The base 11 has a front side surface 111 and a rear side surface 112. In addition, a hook 12 is extending therefrom the rear side surface 112 of the base 11, and the hook 12 is used to hook over the headrail 3. A front side of the base 11 has an opening 13, and an accommodation space 14 with a predetermined depth is extending therefrom a rear side end of the opening 13. Besides, two sides of the accommodation space 14 have a respective mounting plate 15 so as to form sidewalls of the accommodation space 14. The two mounting plates 15 are extending backwardly, and one end of the mounting plates 15 has a protruding portion 151 respectively. The two protruding portions are facing from one another, so that a neck portion 16 with a small diameter is formed therein. Moreover, a plurality of troughs 17 is disposed on the mounting plates 15 respectively, and every two adjacent troughs 17 are spaced apart with a predetermined pitch.

A joint portion 21 is constructed and arranged on a front end of the mounting device 2 and is used to releasably engage with the valance 4. In the preferred embodiment shown, the cross-section profile of the joint portion 21 is dovetailed in shaped, so that the mounting device 2 can be lockly mounted in the groove 41 of the valance 4.

A rear end of the mounting device 2 has a jam portion 22, and a front end of the jam portion 22, where corresponds to the neck portion 16, forms a head 23 that the outer diameter of the head 23 is larger than the inner diameter of the neck portion 16, so that the head 23 can be inserted therein and mounted in the accommodation space 14. Two sides of the head 23 form an angle 231 respectively. Besides, each side of the jam portion 22 has two positioning flanges 24, and the positioning flanges 24 are used for engaging with the corresponding troughs 17.

Also, the mounting device 2 between the joint portion 21 and the jam portion 22 has two tabs 25, and the tabs are used for one to hold and adjust the mounting direction of the mounting device 2 and the valance 4.

Figure 3:
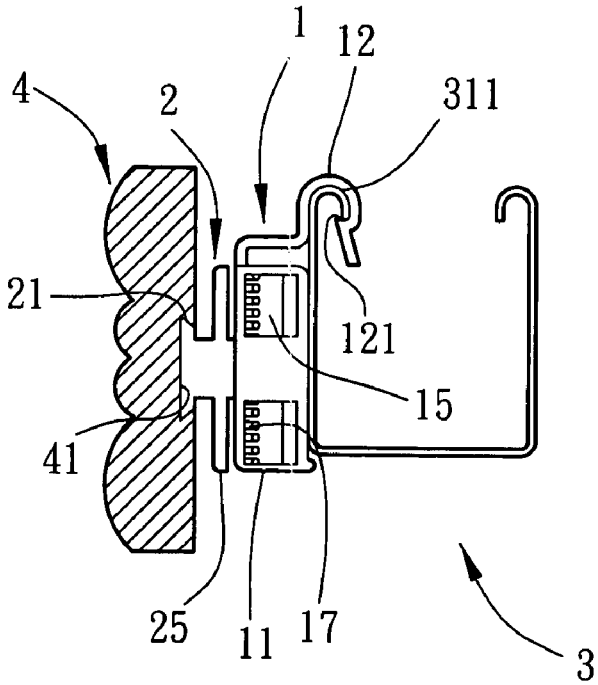
FIG. 3 is a perspective view of the embodiment of the hanging apparatus illustrated in FIG. 1 in which the components of the hanging apparatus have been assembled and engaged to a headrail and a blind valance to show the blind valance secured in front of the headrail.

In the FIG. 3, because the top edge 311 of the headrail 3 is arc shaped, the hook 12 is also designed as arc shaped. In addition, one end of the hook 12, where is far away from the base 11, forms a protruding portion 121, so that the hook 12 can be hooked on the top edge 311 of the headrail 3.

Figure 4:
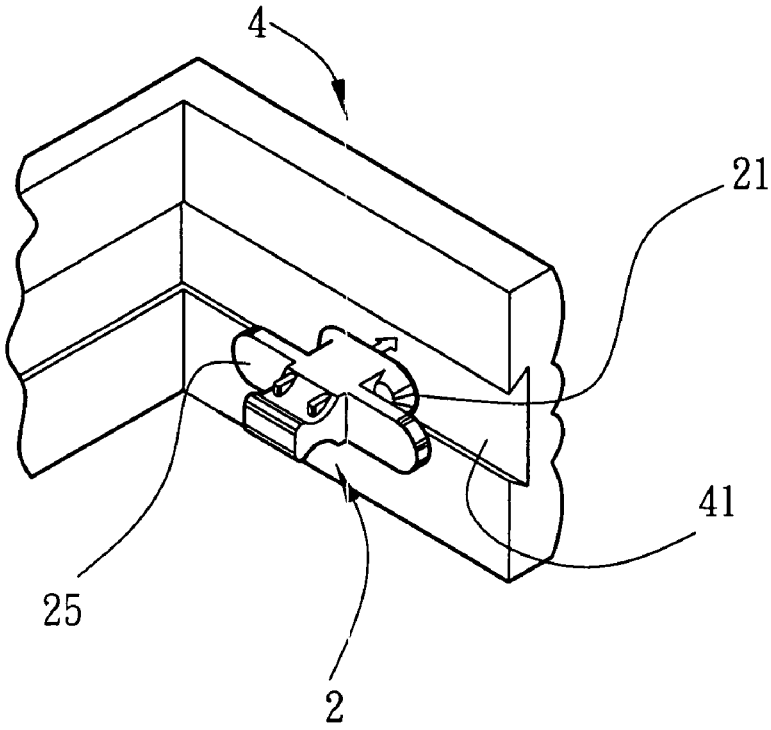
FIG. 4 is a schematic diagram of connecting the mounting device with the valance of the present invention.

Refer to FIG. 4, when the mounting device 2 is mounted with the valance 4, the mounting device 2 is transversely placed. Then the joint portion 21 is engaged with the groove 41 of the valance 4. Therefore, an end-user can hold the tabs 25 and turn the mounting device 2 through 90 degree. Because the shapes of the joint portion 21 and the groove 41 are generally dovetailed in shape, the joint portion 21 therefore can be inserted into and locking engaged with the valance 4 as shown in FIG. 3.

Figure 5:
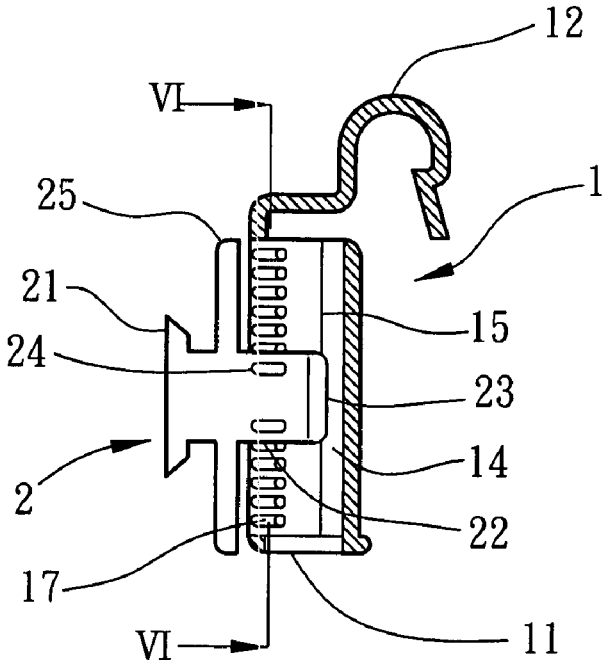
FIG. 5 is a sectional view of the assembly of the present invention.
Figure 6:
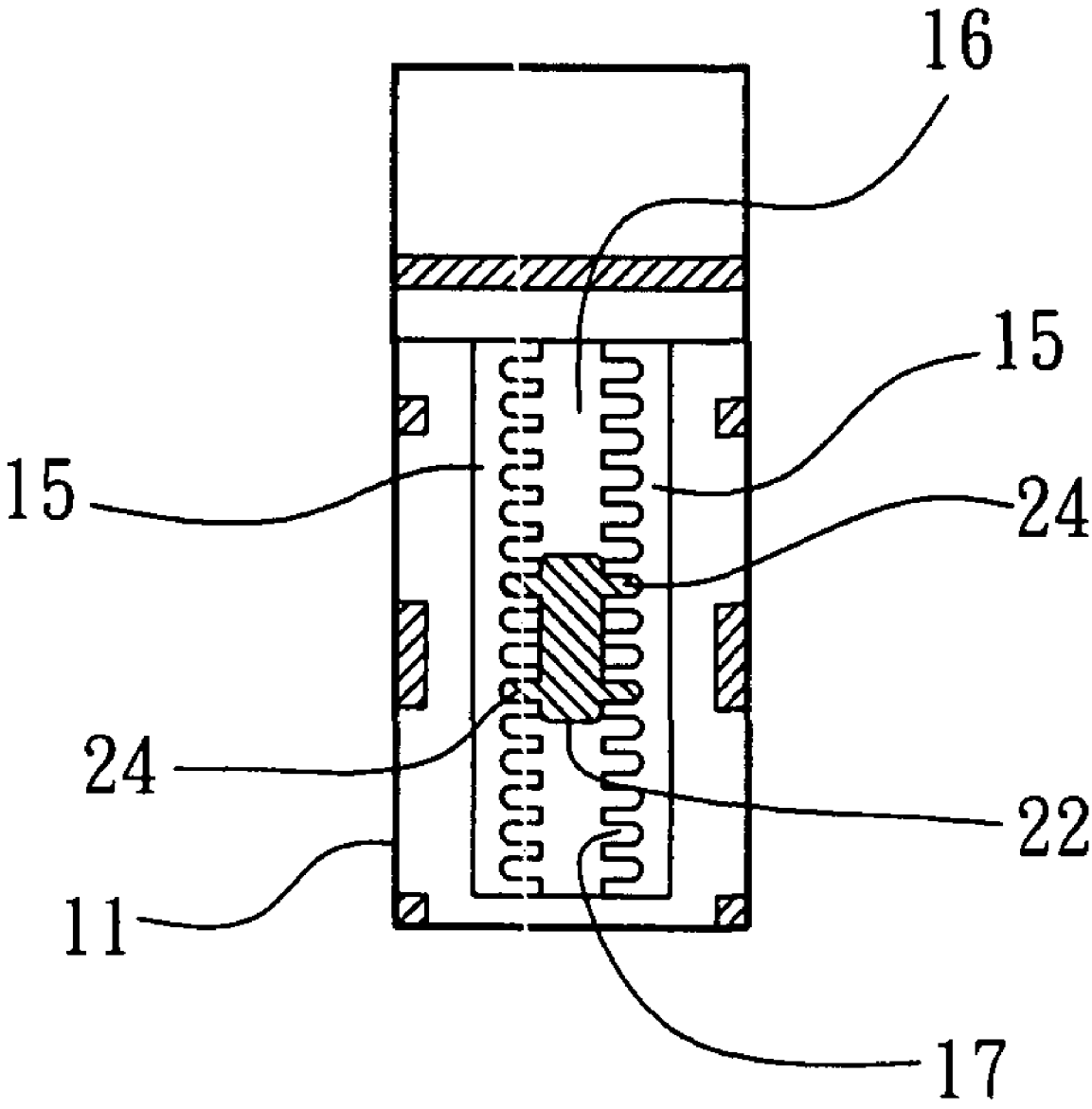
FIG. 6 is a sectional view taken along the line VI-VI according to FIG. 5.

As best seen in FIGS. 5 and 6, because the accommodation space 14 of the hanging device 1 has a predetermined depth in the vertical direction, the jam portion 22 of the mounting device 2 can be horizontally inserted into the accommodation space 14 from any parallel positions of the opening 13 in the vertical direction. In addition, every abutting trough 17 of the mounting plate 15 is spaced apart with a predetermined pitch, such predetermined pitch is equidistant and it will be appreciated that the mounting device 2 is adjustable for its vertical position to a degree within the opening 13 which is a function of the pitch between the troughs 17 on the mounting plate 15.

Moreover, two sides of the jam portion 22 have two positioning flanges 24 respectively. When the jam portion 22 is inserted into the accommodation space 14, the two positioning flanges 24 will be lockly engaged with the corresponding troughs 17. Hence, the mounting device 2 can be kept in a vertical state to avoid undesired tilting or oblique circumstance of the mounting device 2 due to the weight of the valance 4.

In FIG. 2, the two mounting plates 15 are extending from two side of the accommodation space 14, they have adequately elastic. Also, two sides of the head 23 of the jam portion 22 have an angle respectively. Therefore, when the jam portion 22 of the mounting device 2 is inserted into the accommodation space 14, the head 23 is firstly pushed to insert the accommodation space 14. Then the angles 231 of the head 23 will prop up the two elastic mounting plates 15, so that the head 23 can pass through the neck portion 16 of the protruding portion 151. When the head 23 is passing through, the two mounting plates 15 are restored by means of elastic, so that the head 23 is mounted into the accommodation space 14, and the movement of the mounting device in the horizontal direction is therefore limited.

In contrast, when the mounting device 2 is pulled out from the horizontal direction, the two mounting plates 15 will be propped by the head 23 because of elastic force thereof, so that the mounting device 2 can be separated from the hanging device 1.

In other words, once the mounting device 2 is securely engaged with the hanging device 1, there is no further adjustability of the valance with respect to the headrail 3. So, if attempt to adjust the height of the valance 4 relative to the headrail 3, the joint portion 22 has to be horizontally pulled out from the hanging device 1, and then after the height of the valance 4 is adjusted to the desired height, the joint portion 22 of the mounting device 2 is again horizontally inserted into between the mounting plates 15 of the hanging device 1; therefore, the mounting device 2 and the hanging device 1 can be reconnected, so as to achieve the flexible adjustability on valance position with respect to the headrail 3 of a window blind.

Moreover, because the mounting device 2 of the present invention has tabs 25, operators can hold the tabs and apply force to turn the mounting device 2 in order to let the joint portion 21 engage with the groove 41 of the valance 4, so as to achieve the purpose of easy installation scheme in practical usage.

It will be recalled that the shape of the tab 25 is constructed with flat-shaped plate, however, it can also be arranged as cylindrical-shaped or any shapes in equivalent, which may achieve the same desired effects and purpose.

Figure 7:
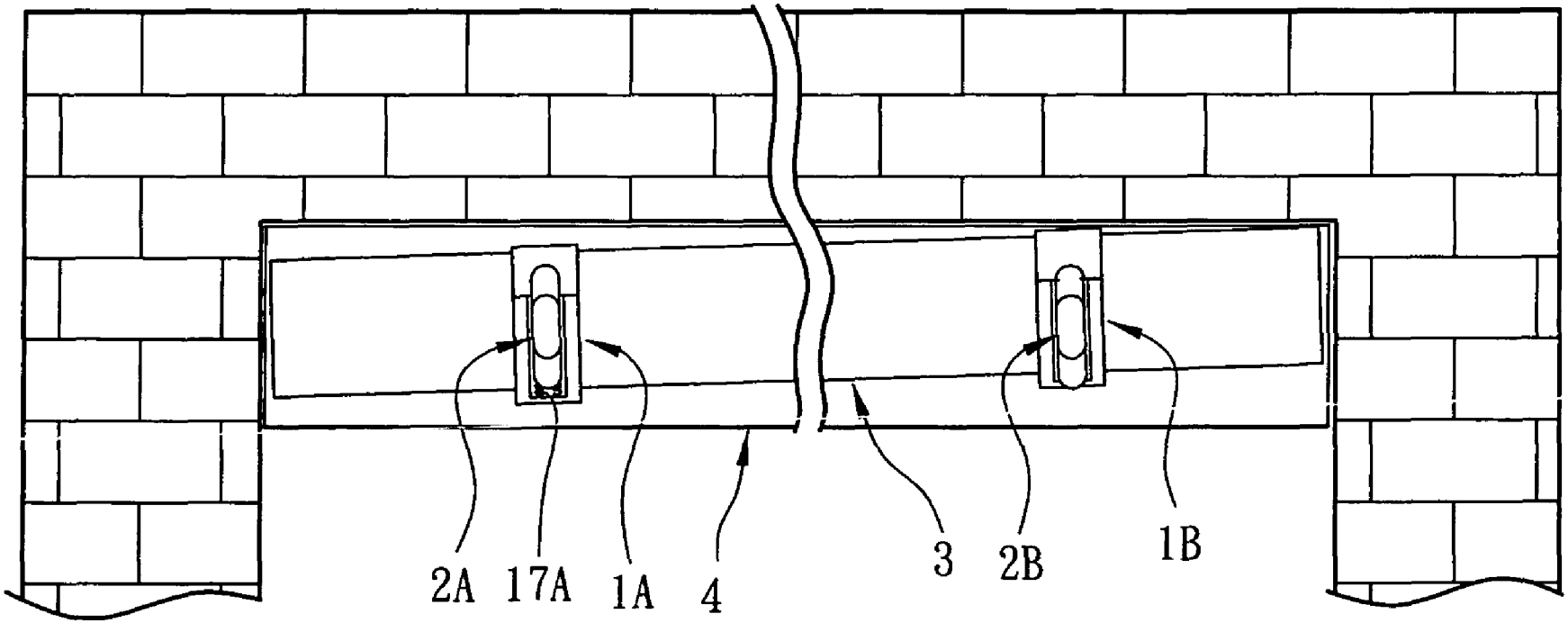
FIG. 7 is a stated diagram in use of the present invention.

In addition, when window frames are not substantially parallel to the floor surface, or the headrail 3 and the orientation of horizontal axis of the window frame has an angle as shown in FIG. 7, the headrail 3 may be oblique or inclined in certain direction along the window frame after installation. Accordingly, one can attach two sets of the adjustable hanging apparatuses of the present invention over the headrail 3 at different positions to perfectly adjust the position of the valance 4 relative to the headrail 3, so that the valance 4 can align with the window frame and fully conceal the headrail 3 behind. In practical installation scheme, as best seen in FIG. 7, mount the mounting device 2A shown on the left-hand side of the FIG. 7 on a higher position of the accommodation space of the hanging device 1A, while this type of arrangement may expose partial of the troughs 17A at lower part of the mounting device 2A. However, the mounting device 2B shown on the right-hand side of FIG. 7 is mounted on a relative lower position of the accommodation space of the hanging device 1B, so that the orientation of longitudinal axis of the valance 4 can coordinate with the orientation of horizontal axis of the window frame to completely conceal the slanting headrail 3 so as to add aesthetic appeal of a window blind.

Figure 8:
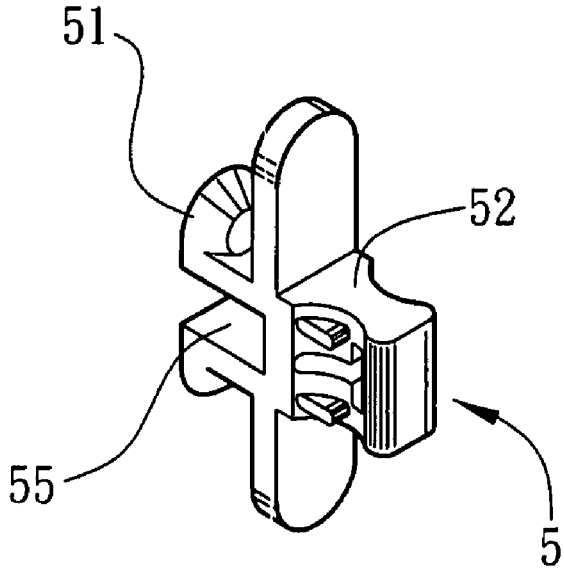
FIG. 8 is a perspective view of the mounting device, showing a second embodiment of the present invention.

A further preferred embodiment of the present invention is illustrated in FIG. 8. In this embodiment, the middle section of the joint portion 51 has a gap 55. The gap 55 is extending from a front end of the mounting device 5 to near the jam portion 52, and is transversely perforating the joint portion 51. Due to the gap 55, a space between two ends of the joint portion 51 is provided for a great flexibility of deformation to a certain degree, so that the joint portion 51 can easily engage into the groove of the valance. Thus, as the joint portion 51 is arranged and constructed with the gap 55, it will substantially reduce the materials usage, while manufacturing the mounting device 5 and thus the overall weight of the mounting device 5 is further reduced.

Figure 9:
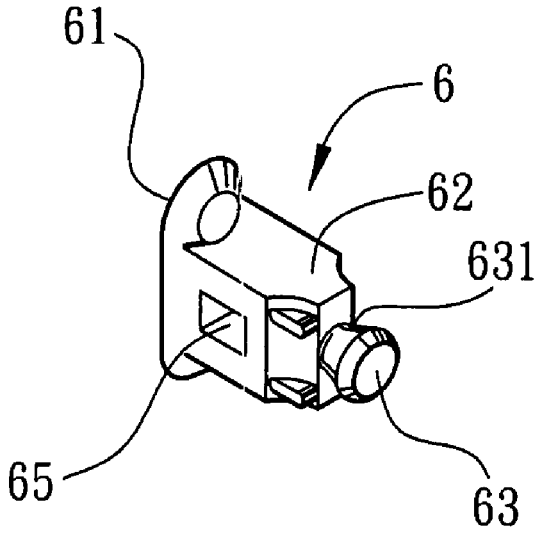
FIG. 9 is a perspective view of the mounting device of a third embodiment of the present invention.

In another preferred embodiment of the present invention shown in FIG. 9, the head 63 in frontmost end of the jam portion 62 is constructed and arranged into a spherical-like shape. And a connecting portion 631 with smaller diameter is provided between the head 63 and the jam portion 62. As a further feature of the invention, the mounting device 6 has a slot 65 located on between the joint portion 61 and the jam portion 62. The slot 65 is aimed to insert an assistant tool means for rotating the mounting device 6, so that the mounting orientation of the mounting device and the valance can be substantially adjusted so as to securely engage the joint portion to the valance.

In this embodiment, the head 63 can also be inserted into the accommodation space, so that the movement of the mounting device can further be limited in the horizontal direction. Therefore, same effect as that of first preferred embodiment could be achieved.

Figure 10:
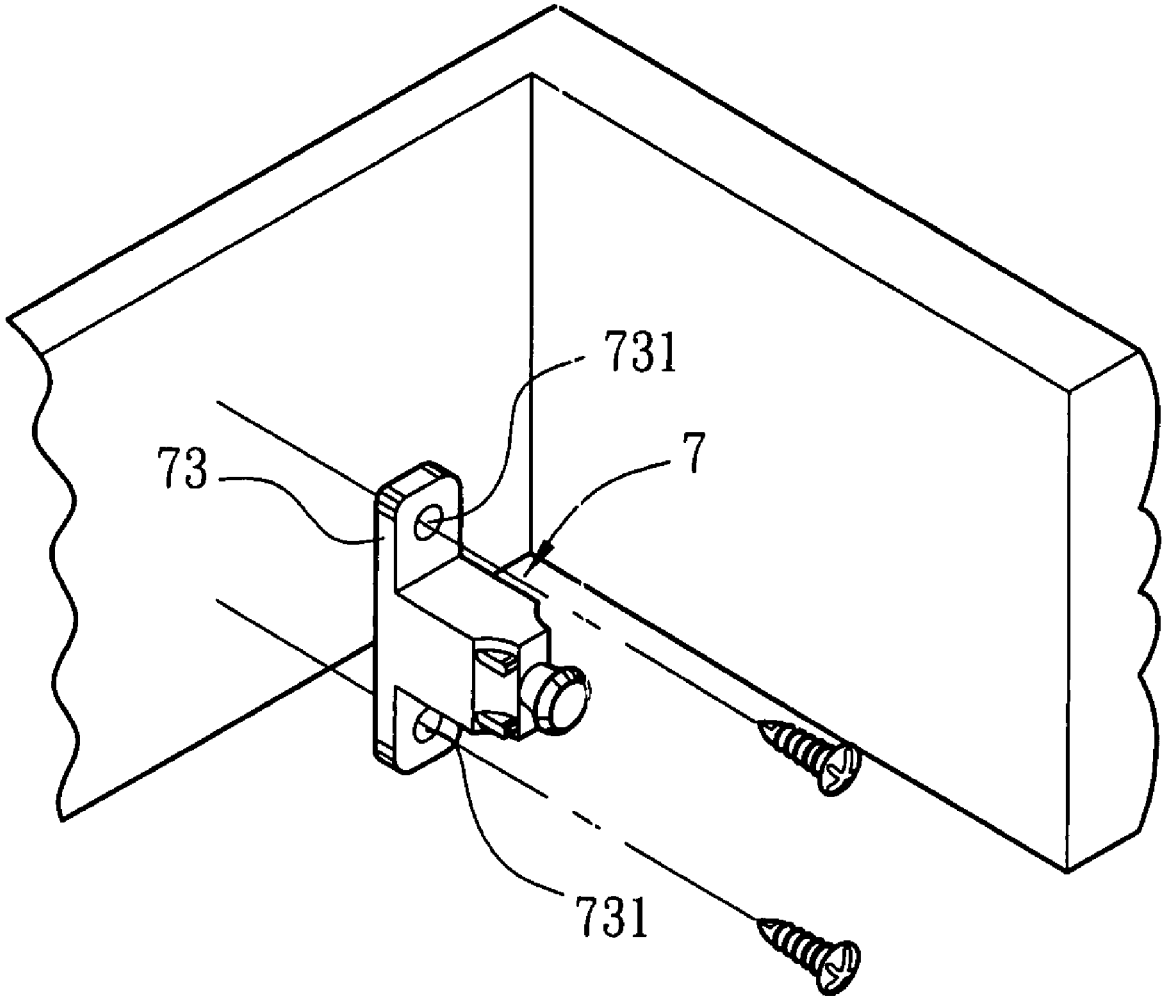
FIG. 10 is a perspective view of the mounting device of a fourth embodiment of the present invention.

In yet another preferred embodiment shown in FIG. 10, the predetermined position of the joint portion 73 of the mounting device 7 has two through holes 731, so that bolts or mounting screws can be mounted to pass through the through holes 731 and securely attach the mounting device 7 to the valance.

The method aspect of this embodiment is to engage the mounting device with the valance without the groove; therefore, the connecting section is not necessary to be constructed and arranged with a tab or a slot, and it can achieve the same desired effects as that of the first embodiment.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An adjustable hanging apparatus for blind valances, wherein a window blind has a headrail and the hanging apparatus is disposed on a predetermined position of the headrail, so that the valance can be disposed thereon, the hanging apparatus comprising:

a hanging device, having a base and a hook disposed on a rear side of the base, the hook being used to hook on the predetermined position of the headrail, and an opening being disposed on a front side of the base and backwardly extending with a predetermined depth to form an accommodation space, and a plurality of troughs being disposed on side walls of the accommodation space; and a mounting device, having a joint portion disposed on a front end thereof so as to mount with the valance, a jam portion disposed on a rear end of the mounting device, at least one positioning flange disposed at the exterior of the mounting device so as to be inserted into at least one corresponding trough, wherein the jam portion of the mounting device is inserted into the accommodation space through the opening, and the positioning flange is simultaneously inserted into the corresponding trough, and wherein the accommodation space has two mounting plates, one end of each of the two mounting plates extending backwardly to form a projection portion so as to define a neck portion with a reduced width, the mounting plates form the side walls of the accommodation space and the plurality of troughs are formed on the mounting plates respectively.

2. The adjustable hanging apparatus for blind valances as claimed in claim 1, wherein the jam portion forms a head having an outer diameter larger than that of the neck portion in a location that the jam portion and the neck portion of the accommodation space are engaged with each other so that the jam portion is fixed in the accommodation space.

3. The adjustable hanging apparatus for blind valances as claimed in claim 1, wherein a head of the jam portion has at least one rounded corner.

4. The adjustable hanging apparatus for blind valances as claimed in claim 1, wherein the joint portion has a through hole located on a predetermined position thereof so that bolts are inserted into the through hole to mount the valance.

5. The adjustable hanging apparatus for blind valances as claimed in claim 1, wherein the joint portion is generally dovetailed in shape.

6. The adjustable hanging apparatus for blind valances as claimed in claim 1, wherein a middle section of the joint portion has a gap, the gap backwardly extending from a front end of the mounting device to approach the jam portion, and perforating through the joint portion in a transverse direction.

7. The adjustable hanging apparatus for blind valances as claimed in claim 1, wherein said at least one positioning flange of the jam portion is configured to be inserted into the corresponding trough, and every two adjacent troughs are spaced apart with a predetermined pitch.

8. The adjustable hanging apparatus for blind valances as claimed in claim 1, wherein the mounting device has at least one tab located between the joint portion and the jam portion for adjusting a mounting direction of the mounting device and the valance.

9. The adjustable hanging apparatus for blind valances as claimed in claim 1, wherein the mounting device has a slot located between the joint portion and the jam portion, so that an assistant member is inserted into the slot to adjust a mounting direction of the mounting device and the valance.

* * * * *